US005416934A

United States Patent [19]

Bracken et al.

[11] Patent Number: 5,416,934

[45] Date of Patent: May 23, 1995

[54] BABY CRIB WITH PULL-OUT MATTRESS AND PIVOTABLE LEG

[76] Inventors: Lynda J. Bracken; Philip J. Bracken, both of 7319 Capps Ave., Reseda, Calif. 91335; Patrick Bracken, 21019 Gault, Canoga Park, Calif. 91303

[21] Appl. No.: 161,484

[22] Filed: Dec. 6, 1993

[51] Int. Cl.[6] ..... A47D 7/03; A47D 7/02

[52] U.S. Cl. ..... 5/93.1; 5/100; 5/312

[58] Field of Search ..... 5/93.1, 100, 312, 310, 5/311, 17, 18.1, 11

[56] References Cited

U.S. PATENT DOCUMENTS

| | | | |
|---|---|---|---|
| 2,477,231 | 7/1949 | Bourdon | 5/93.1 |
| 3,327,328 | 6/1967 | Slivoski | 5/312 |
| 5,038,422 | 8/1991 | Messina | 5/12.1 |
| 5,054,138 | 10/1991 | Wesley | 5/93.1 |
| 5,101,524 | 4/1992 | Brandschain | 5/18.1 |
| 5,195,193 | 3/1993 | Magistretti | 5/18.1 |

*Primary Examiner*—Alexander Grosz
*Attorney, Agent, or Firm*—Albert O. Cota

[57] ABSTRACT

A baby crib with pull-out mattress (10) that is designed with a mattress frame (20) and mattress (22) that can be pulled outwardly away from the front perimeter of the crib. With the mattress (22) completely exposed, the mattress covering(s) can be easily and quickly removed and changed. This feature aids in convenience and ease as well as preventing back aches that frequently occur from bending over the crib's front rail to change the mattress covering(s). To allow the mattress frame (20) and mattress (22) to be slid in and out, they are attached to a first and second horizontal slide assembly (26). The crib (10) design also includes a retractable leg assembly (30) that is normally placed in a retracted position underneath the mattress frame (20). However, when the horizontal slide assembly (26) is slid forwardly, the retractable leg assembly (30) automatically causes a retractable leg (30A) to pivot downward to support the extended mattress frame (20).

15 Claims, 5 Drawing Sheets

BABY CRIB WITH PULL-OUT MATTRESS AND PIVOTABLE LEG

TECHNICAL FIELD

The invention pertains to the general field of baby cribs and more particularly to a baby crib having provisions to allow the mattress frame and mattress to be extended beyond the crib perimeter to allow mattress coverings to be easily applied and removed.

BACKGROUND ART

The use and utility of baby cribs has long been established. Typically, baby cribs are used during the infancy stage of a child. During this period, the baby must be kept hygienically clean by changing the mattress coverings at least daily. However, more often than not, two or three mattress covering changes are required daily; especially with new born babies or when the baby is ill.

The most basic problem in changing mattress coverings is that the person making the change must bend over the crib's front railing to reach the mattress and adjust the mattress coverings. Even if the movable front side of the crib is lowered, there still remains a sufficient distance to the mattress that makes the changing of the mattress inconvenient and difficult. Also, the constant reaching can eventually lead to back aches and other recurring ailments.

A search of literature and the prior art did not disclose any patents that read directly on the claims of the instant invention, however the following U.S. patents are considered related:

| U.S. PAT. NO. | INVENTOR | ISSUED |
|---|---|---|
| 5,195,193 | Magistretti | 23 March 1993 |
| 5,101,024 | Brandschain | 7 April 1992 |
| 5,054,138 | Wesley | 8 October 1991 |
| 5,038,422 | Messina | 13 August 1991 |

The U.S. Pat. No. 5,195,193 Magistretti patent discloses a convertible sofa that includes a rectangular supporting frame provided with a feet support structure that rests on the floor. The sofa includes rigid vertical structures forming the back and arms, two pairs of rectilinear guides parallel to each other and that carry the arms on the traverse sides. Between each pair of slides are mounted free-running rollers with horizontal axes capable of supporting and guiding a respective bar-shaped member. The member is freely slidable between the pairs of parallel guides which are integral at their front ends with a longitudinal bar provided with supporting wheels resting on the floor. This design enable two stable positions, one of which corresponds to a single bed position.

The U.S. Pat. No. 5,101,524 Brands chain patent discloses a sofa that is convertible into a platform bed having a transversely extending stationary frame. A left arm assembly, a right arm assembly and a back assembly are attached to the stationary frame. The sofa seat and back cushions are removable from a support surface located above the stationary frame. A plurality of laterally spaced telescoping slide assemblies have their rear ends secured to the stationary frame. Each slide assembly has an elongated rear telescoping member, at least one elongated intermediate telescoping member and an elongated front telescoping member. Additionally, all of the telescoping members have a top wall surface that remains in substantially the same horizontal plane when they are in their retracted position and when they are in their extended position. The cushion support platform assembly stows in a position above the stationary frame and below the seat cushion. The cushion support platform in its extended position has a bottom planar surface that rests on the planar top surface of the telescoping slide assemblies in their extended state.

The U.S. Pat. No. 5,054,138 Wesley patent discloses a crib apparatus that is slidably mounted within a crib mattress cavity. The mattress cavity pivotally mounts a mattress cavity door located at the forward edge of the crib. Upon opening the cavity door, a mattress slide plate is slidably mounted that supports a crib mattress. When the slide plate is slid forward, the mattress can be removed for cleaning and maintenance thereof. The crib apparatus includes heated support cavities for supporting infant food and fluid nursing bottles.

The U.S. Pat. No. 5,038,422 Messina patent discloses a support structure for sofa beds. The structure includes a pull-out raisable auxiliary bed, which has an upper frame carrying support for a mattress. The bed is connected by rods linked as a parallelogram, to two lower bars transverse to the larger dimension of the frame. Blocking structure is also included for the raised position and balancing means for the weight of the frame. The sofa bed is also equipped with a seat-back adjustable in position.

For background purposes and as indicative of the art to which the invention is related reference may be made to the remaining cited patents.

| U.S. PAT. NO. | INVENTOR | ISSUED |
|---|---|---|
| 4,200,941 | Gill | 6 May 1980 |
| 3,608,105 | Flatford | 28 September 1971 |
| 3,327,328 | Slivoski | 2 April 1965 |
| 2,477,231 | Bourdon | 22 April 1947 |

DISCLOSURE OF THE INVENTION

The baby crib with pull-out mattress was conceived and designed to alleviate the problem of having to bend over a baby crib rail to change the coverings of a mattress. The continual bending over apart from being difficult and inconvenient, can cause back aches especially to persons that have an existing back problem. The inventive crib solves these problems by providing a baby crib featuring a mattress frame and mattress that can be pulled outwardly away from the front perimeter of the crib. Once pulled out, it is completely exposed thus, allowing the mattress coverings to be easily and quickly changed. In its most basic form, the baby crib with pull-out mattress consists of the following elements:

1. a crib first end and second end with each end having legs,
2. a mattress frame connected between the first and second ends,
3. a mattress resting on the frame,
4. a back side attached by an attachment means to the first and second ends adjacent to the mattress frame and mattress,
5. a movable front side having means for being moved relative to the first and second ends. The front side is moved a sufficient distance to permit the mattress frame and mattress to be exposed.

6. means for allowing the mattress frame and mattress to slide outwardly away from the back side, and
7. a retractable leg assembly hingably attached to the mattress frame. When the movable front side is displaced from the first and second ends and the mattress frame and mattress are slid outwardly, the retractable leg automatically extends downward to provide support to the outwardly extended mattress frame and mattress.

The preferred means for moving the movable front side, is accomplished by a first and second vertical slide and locking assembly. Each assembly consists of a fixed section that is attached to the inner side of the front edge of the crib's first and second ends and a slidable section that is attached to the vertical side edges of the movable front side. The assemblies permit the front side to be releasably retained in an upward position. The preferred means for allowing the mattress frame to slide outwardly is accomplished by a first and second horizontal slide assembly. Each assembly consists of a fixed section that is attached laterally to the inward inside surface of the respective legs. The slidable sections are attached to the bottom surface of the mattress frame. The slide assemblies allow the mattress frame to easily slide outwardly away from the back side of the crib to permit the mattress coverings to be easily changed.

The primary improvements of the invention are the means for allowing the mattress frame and mattress to be pulled out, and the retractable leg assembly. These elements can be retrofitted on an existing conventional baby crib or can be incorporated as original equipment.

In view of the above disclosure, it is the primary object of the invention to provide a baby crib that allows a mattress frame and mattress to be pulled away from the crib to permit the mattress coverings to be easily changed.

In addition to the primary object of the invention, it is also an object to provide a crib that:

still retains the features of existing cribs.
simplifies the changing of mattress coverings while reducing incidents of back aches,
helps new mothers who have had a c-section,
saves time and reduces stress,
no longer becomes a chore that people dislike,
the crib will be changed more often and hence, a healthier child,
is reliable and relatively maintenance free, and
is cost effective from both a manufacturing and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
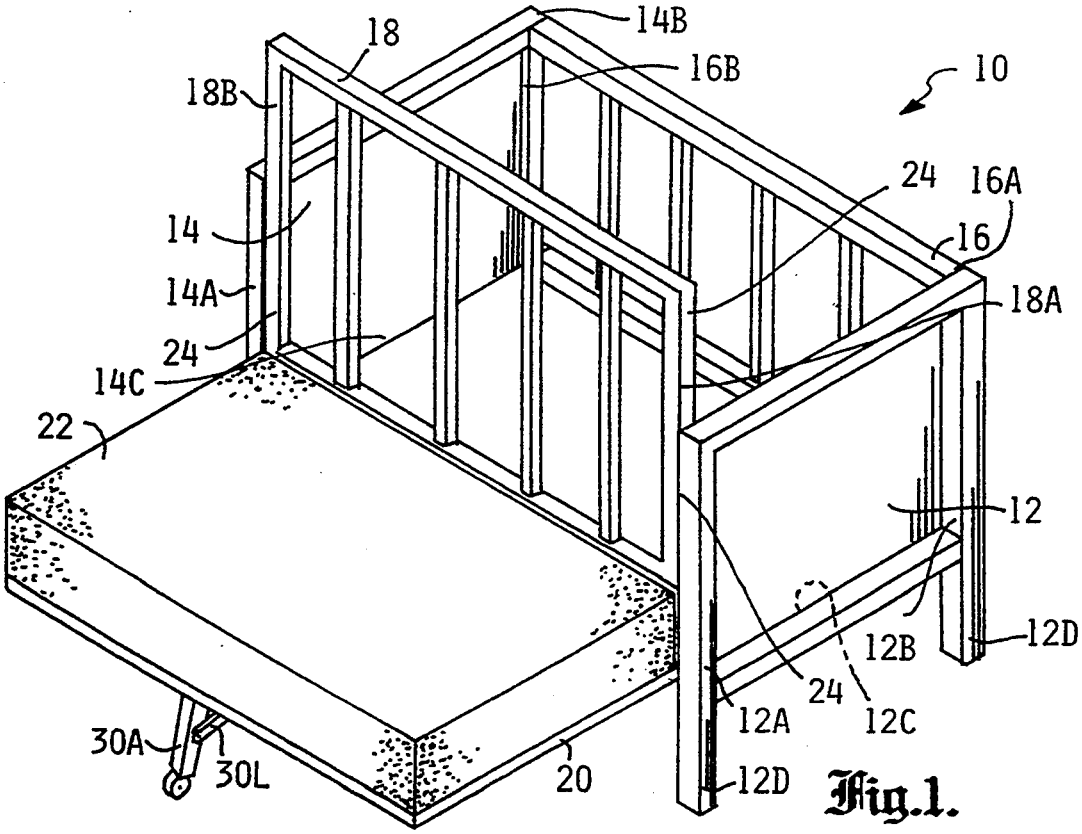
FIG. 1 is a perspective view of the baby crib with pull-out mattress showing the movable front side extended upwardly and the mattress frame and mattress extended outwardly.

The best mode for carrying out the invention is presented in terms of a preferred embodiment that is designed to allow a mattress frame and mattress to be slid outwardly. This feature then allows the mattress coverings to be changed without interference from the crib side structure.

The preferred embodiment as shown in FIGS. 1–14, is comprised of the following major elements: a first end 12, a second end 14, a back side 16, a movable front side 18, a mattress frame 20, a first and second vertical slide and locking assembly 24, a first and second horizontal slide assembly 26 and a retractable leg assembly 30.

Figure 2:
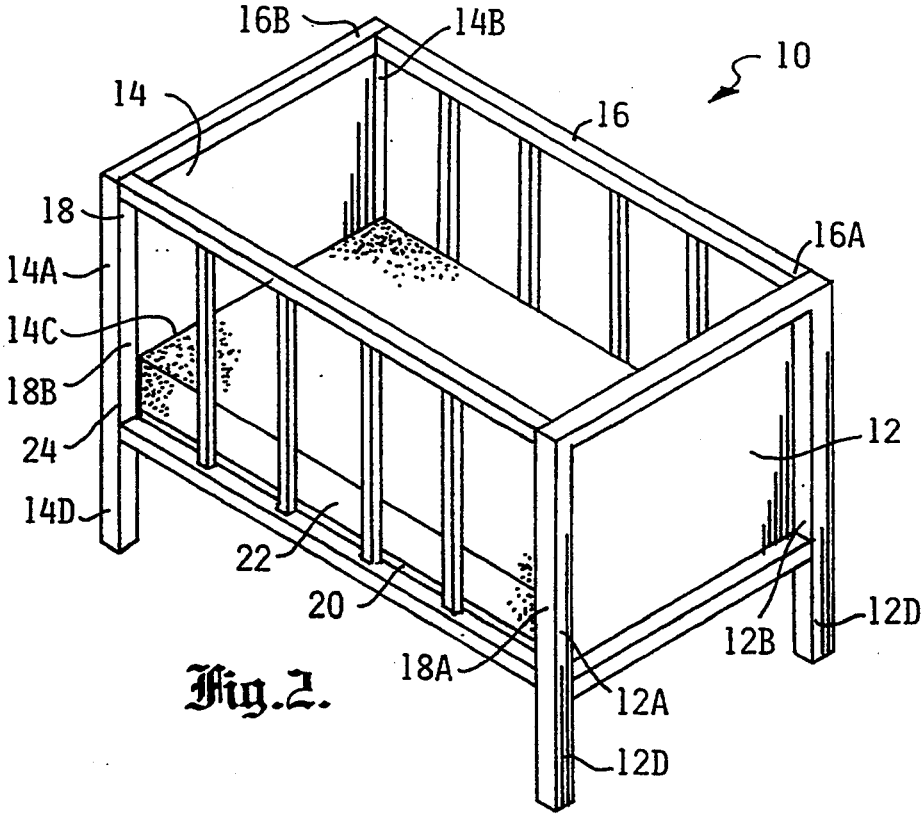
FIG. 2 is a perspective view of the baby crib showing the movable front side in its normal position and the mattress frame and mattress in their inward sleeping position.

The crib structure as shown in FIGS. 1 and 2 is constructed of the first end 12, the second end 14, a back side 16 and a movable front side 18.

Figure 5:
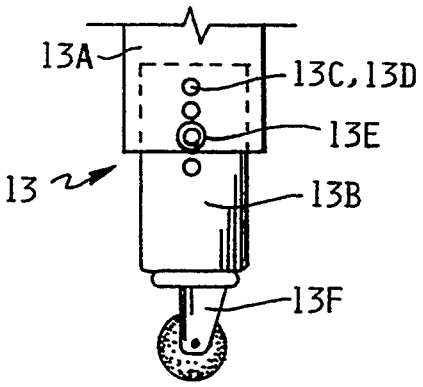
FIG. 5 is an elevational view of a crib leg or retractable leg equipped with a leg-height adjusting means.

The first end 12 further includes a front edge 12A, a back edge 12B, a bottom inside edge 12C and a pair of downwardly extending legs 12D. The second end 14 likewise includes a front edge 14A, a back edge 14B, a bottom inside edge 14C and a pair of downwardly extending legs 14D. The back side 16 has a first side edge 16A and a second side edge 16B. These sides are attached by an attachment means to the respective back edges 12B,14B of the first and second ends 12,14. For convenience to the crib 10, the legs 12D,14D may be made to include a leg-height adjustment means 13. In the preferred embodiment as shown in FIG. 5, the leg-height adjusting means 13 consists of an upper tubular section 13A and a lower solid section 13B. The upper tubular section has a plurality of first adjustment bores 13C therethrough; likewise, the lower solid section has a plurality of second adjustment bores 13D. When the desired height has been determined, a pine 13E is inserted into the first and second pin bores to hold the retractable leg at the selectable height. To the bottom of the lower solid section may also be added a roller 13F to facilitate the movement of the crib 10. To complete the baby crib structure as shown in FIG. 1, the movable front side 18 which has a first side edge 18A and a second side edge 18B is preferably attached by means of a first and second vertical slide and locking assembly 24 described infra.

Figure 10:
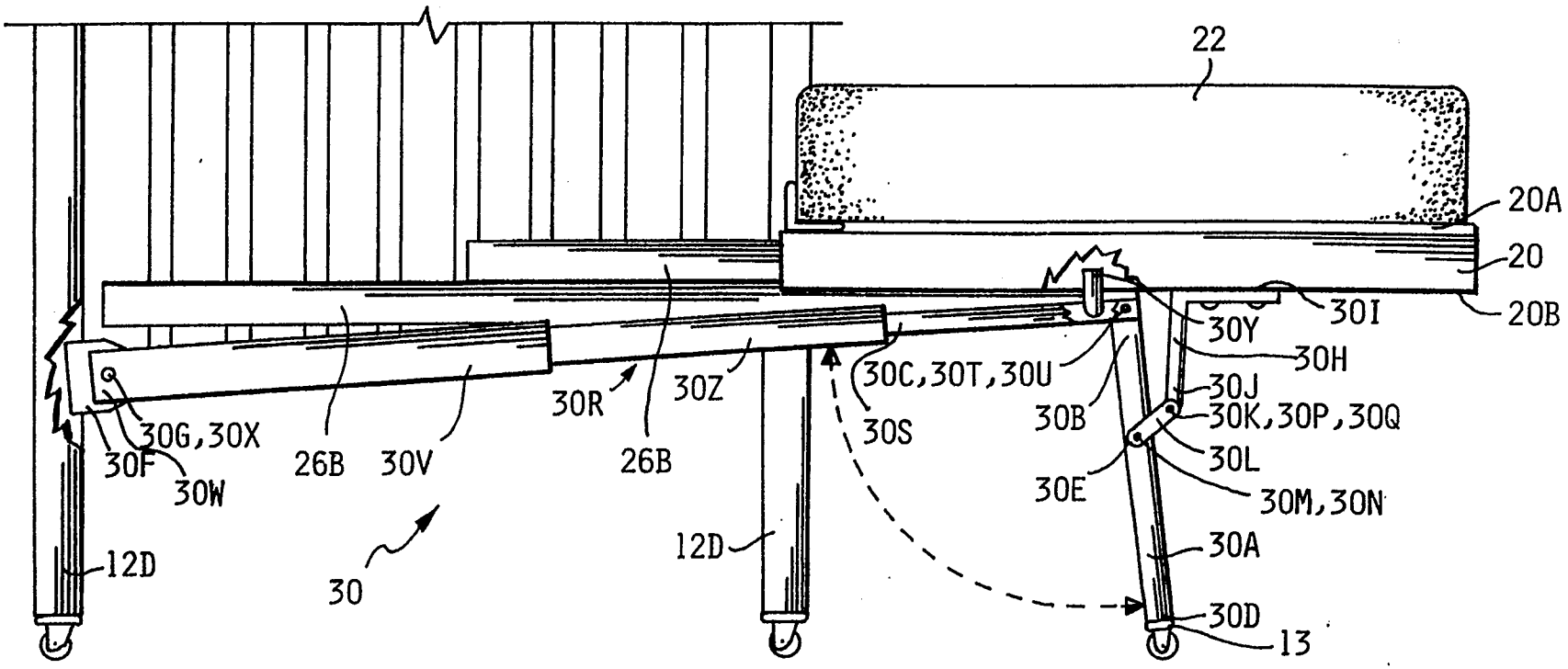
FIG. 10 is an elevational side view of the retractable leg assembly shown in its fully extended position.

The platform for the crib 10 as shown in FIGS. 1 and 10, is the mattress frame 20 which is connected between the first and second ends 12,14. This frame, as shown best in FIG. 10, supports the mattress 22, has an upper surface 20A, a bottom surface 20B and means for changing the height of said mattress frame relative to the first and second ends 12,14. Typically, the adjusting means consists of a set of hooks attached to the ends of the mattress frame 20. The hooks attach to hook receptors placed vertically along the inside of the front and back edges 12A,12B and 14A,14B of the first and second ends 12,14.

Figure 3:
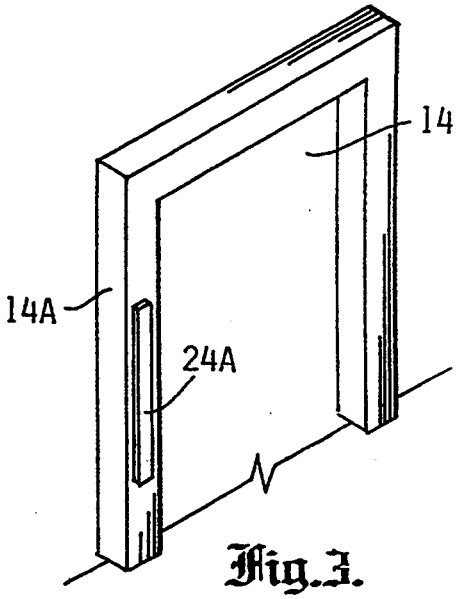
FIG. 3 is an inward, partial perspective view of the second end of the crib showing the location of the fixed section of the first and second vertical slide and locking assembly.
Figure 4:
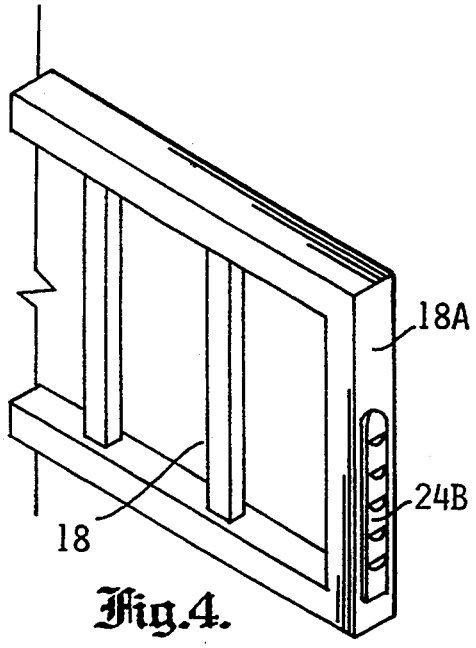
FIG. 4 is an outward, partial perspective view of the movable front side showing the location of the slidable section of the first and second vertical slide and locking assembly.
Figure 6:
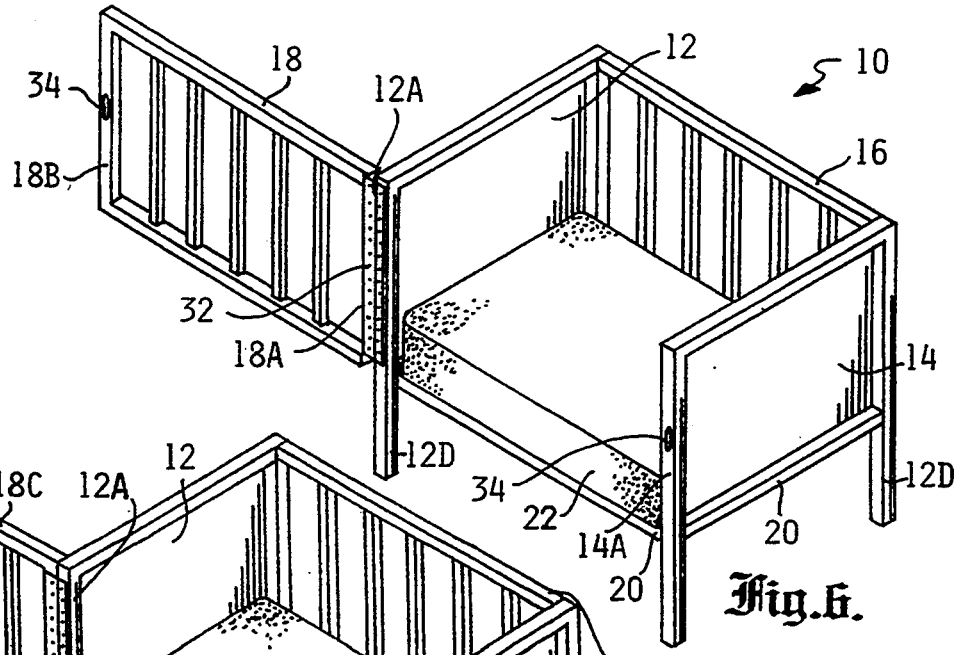
FIG. 6 is a perspective view of a baby crib having a movable front side that has its first side hinged to the leg extension.
Figure 7:
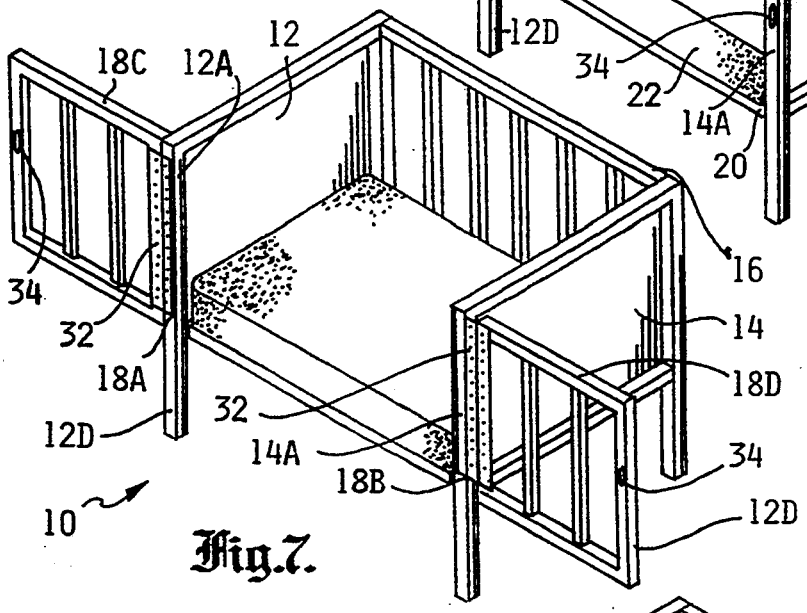
FIG. 7 is a perspective view of a baby crib having a movable front side split into a left piece and a right piece where the outward ends of the two pieces are hinged to the respective leg extensions.
Figure 8:
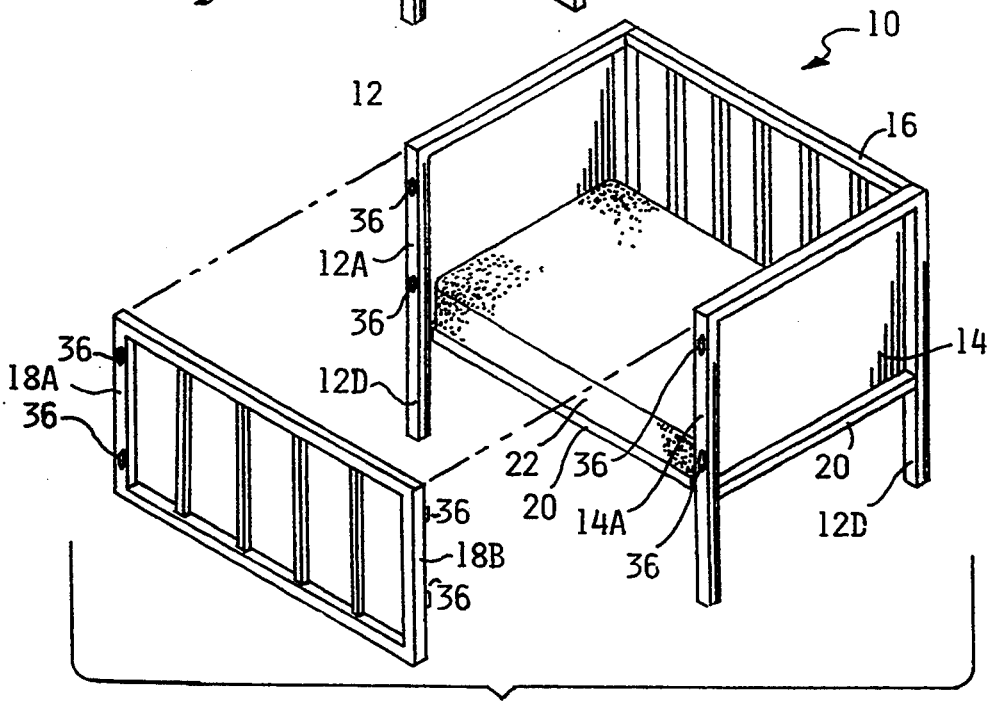
FIG. 8 is a perspective view of a baby crib having a movable front side that can be completely removed from the crib.

In order to allow the mattress frame 20 and mattress 22 to be slid forward as shown in FIG. 10, the movable front side 18 must first be raised as shown in FIG. 1, or otherwise displaced as shown in FIGS. 6–8. The preferred raising, is accomplished by the first and second vertical slide and locking assemblies 24 as shown in FIGS. 3 and 4. Each assembly 24 consists of a fixed section 24A and a slidable section 24B that permits the movable front side 18 to be releasably retained in an upward position as shown in FIG. 1. The fixed sections 24A are attached respectively to the inner side of the front edge 12A,14A of the first and second ends 12,14 as shown best in FIG. 3. The slidable sections 24B, as shown in FIG. 4, are attached to the first and second side edges 18A,18B of the movable front side 18. When the two sections of the assembly 24 interface, the movable front side 18 can be positioned vertically upwards and locked, relative to the first and second ends 12, 14, a sufficient distance to permit the mattress frame 20 and mattress 22 to be exposed. The front side 18 can also be lowered and locked to facilitate lifting a baby from the mattress 22. After the baby is lifted out of the crib, the front side 18 can be returned to its normal position and locked or raised and locked to change the mattress coverings.

In addition to the preferred vertically repositioning structure that utilizes the first and second vertical slide and locking assembly 24, there is also disclosed three other structures and methods for allowing the movable front side 18 to be moved to permit the frame 20 and mattress 22 to be exposed.

The first other method as shown in FIG. 6, consists of a vertical hinge 32 that is attached between the first side edge 18A of the movable front side 18 and the front edge 12A of the first end 12. The hinge location can also be likewise attached between the second side edge 18B of the movable front side 18 and the front edge 14A of the second end 14. In either case, a latch pair 34 is located on the end opposite the hinge 32 to allow the movable front side to be secured when closed. The hinge 32 allows the entire unlatched movable front side 18 to pivot outwardly to permit the mattress frame 20 and mattress 22 to be exposed.

The second method as shown in FIG. 7, utilizes a movable front side 18 that is vertically split into two separate pieces: a left piece 18C and a right piece 18D. In this design, a vertical hinge 32 is attached between the first side edge 18A and the second side edge 18B of the movable front side 18 and to the front edges 12A,14A of the first and second ends 12,14. Between the two interfacing inward ends of the left and right pieces 18C,18D is located a latch pair 34 that receives the two pieces together when they are in their closed positions. When the latch pair 34 is unlatched each piece 18C,18D can pivot outwardly about the respective hinge 32 to permit the mattress frame 20 and mattress 22 to be exposed.

The third and final method disclosed is shown in FIG. 8. In this method, a pair of removable fasteners 36 are attached in alignment, to the first and second side edges 18A,18D of the movable front side 18 and to the front edges 12A,14A of the first and second ends 12,14. When the movable front side is lifted, the entire side may be removed to permit the mattress frame 20 and mattress 22 to be exposed.

Figure 9:
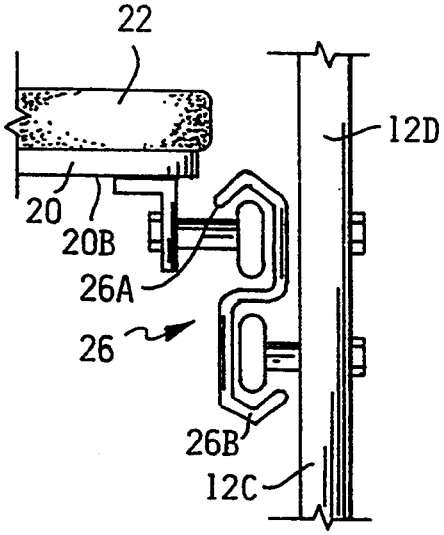
FIG. 9 is a front elevational view of a typical first and second horizontal slide assembly.
Figure 14:
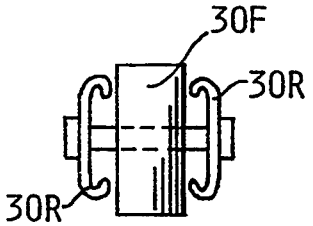
FIG. 14 is an elevational view taken along the lines 14—14 of FIG. 12.

After the mattress frame 20 and the mattress 22 are exposed as described above, they are slid outwardly preferably by a first and second horizontal slide assembly 26 as shown in FIG. 9. Each of The assemblies 26 consists of a fixed section 26A and a slidable section 26B. The fixed sections preferably extend laterally across the width of the first and second ends 12,14 and are attached to the inward inside surface 12C,14C of the respective legs 12D,14D. The slidable sections 26B are attached to the bottom surface 20B of the mattress frame 20. The first and second horizontal slide assemblies 26 allow the mattress frame 20 and mattress 22 to easily slide outwardly away from the back side as shown in FIGS. 1 and 14, for convenience in the application of mattress coverings.

Figure 11:
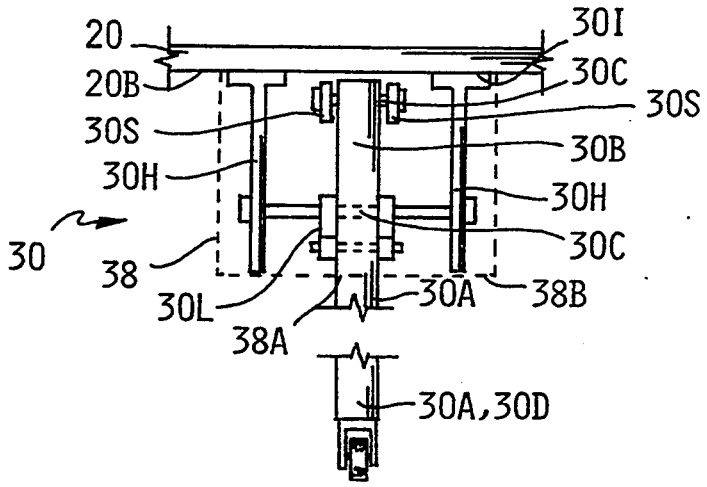
FIG. 11 is a elevational front view of the retractable leg assembly shown in its fully extended position.

To add stability to the extended mattress frame 20 and mattress 22, the retractable leg assembly 30 is employed. The assembly 10 in its fully extended position is shown in FIGS. 10 and 11 and in its fully retracted position in FIGS. 12, 13 and 14. The assembly 30 as shown best in FIG. 10, consists of a retractable leg 30A having a first end 30B and a second end 30D. The first end includes a first pivot bore 30C and near the middle of the leg substantially separated from the first pivot bore 30C, is a second pivot bore 30E as shown in FIGS. 10 and 11.

The assembly 30 is attached to the crib 10 by means of a slide mounting block 30F and a leg bracket 30H. The block 30F is attached to the inside surface of the back side 16 as shown in FIG. 10, below the mattress frame 20 and includes a third pivot bore 30G therethrough. The leg bracket 30H has an upper surface 30I that is rigidly attached to the bottom surface 20B of the mattress frame 20 by an attachment means. The bracket also has a bottom 30J that has a fourth pivot bore 30K therethrough.

The leg 30A is attached to the leg bracket 30H by means of a pair of movable links 30L having a first end 30M that includes a fifth pivot bore 30N and a second end 30P having a sixth pivot bore 30Q. The fifth pivot bore 30N is swivelly attached to the second pivot bore 30E by means of a pin; likewise, the sixth pivot bore 30Q is swivelly attached to the fourth pivot bore 30K.

Between the first end 30B of the retractable leg 30A and the slide mounting block 30F is swivelly attached a multi-sectioned, retractable leg slide 30Z as shown in FIG. 10. This slide in the preferred embodiment, consists of three sections; a back slide section 30V, a center slide section 30Z that slides in and out of section 30V, and a front slide section 30S that slides in and out of section 30Z. The front slide section 30S has a forward end 30T having a seventh pin bore 30U and the back slide section 30V has a rearward end 30W having an eighth pivot bore 30X. The seventh pivot bore 30U is swivelly attached to the first pivot bore 30C and the eighth pivot bore 30X is swivelly attached to the third pivot bore 30G. All bores are swivelly attached by means of a captive pin.

To complete the retractable leg assembly 30, a slide stop-rod 30Y is attached to the bottom surface 20B of the mattress frame 20 adjacent to the intersection of the retractable leg 30A with the front slide section 30S of the multi-sectioned, retractable leg slide 30R. The slide stop-rod 30Y halts the travel of the mattress frame 20 when it has reached its fully extended position as shown best in FIG. 10. The retractable leg in the preferred embodiment includes a leg-height adjusting means 13. The preferred leg adjusting means as shown in FIG. 5, consists of an upper tubular section 13A and a lower solid section 13B. The upper tubular section has therethrough a plurality of first adjustment bores 13C that correspond to a plurality of second adjustment bores 13D located therethrough on the lower solid section 13B. To hold the retractable leg at a selectable height, a pin 13E is inserted into the respective first and second adjustment bores. A leg height adjustment would be required to compensate for the increase or decrease in height when the mattress frame 20 is set to a selectable height. Additionally, the retractable leg assembly 30 may be enclosed by a safety cover 38 as shown in FIG. 11. The cover 38 includes a longitudinal slot 38A therethrough on its bottom surface 38B. The slot is sized to allow the retractable leg 30A to pivotally be extended and retracted through the slot 38A.

When the mattress frame 20 and mattress 22 are slid outwardly, the retractable leg assembly 30 is automatically activated until it is fully extended as shown in FIGS. 10 and 11. In operation, the retractable leg 30A pivots about the first and seventh pivot bores 30C,30U and pivot bores 30M,30N as it rotates downwardly from its retracted position as shown sequentially in FIGS. 12 and 10. The retractable leg 30A rotates until it is fully extended at which time the leg 30A touches the floor on its second end 30D to support the mattress frame 20 and mattress 22 while the mattress coverings are being removed or applied.

Figure 12:
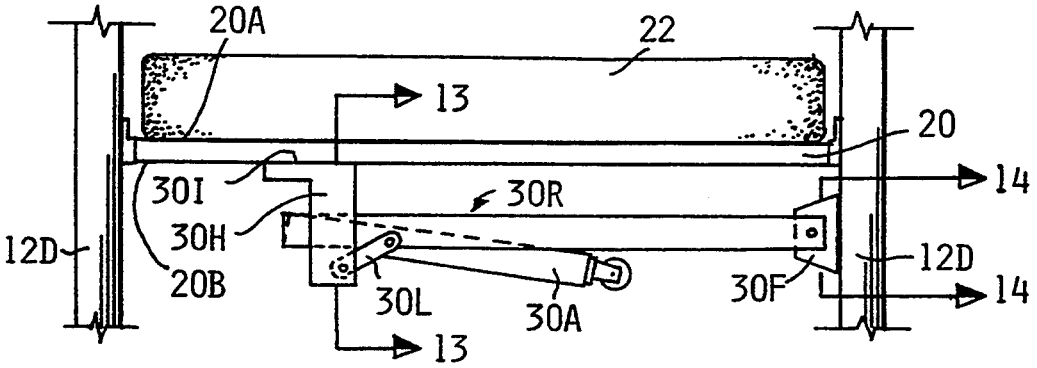
FIG. 12 is an elevational side view of the retractable leg assembly shown in its fully retracted position.
Figure 13:
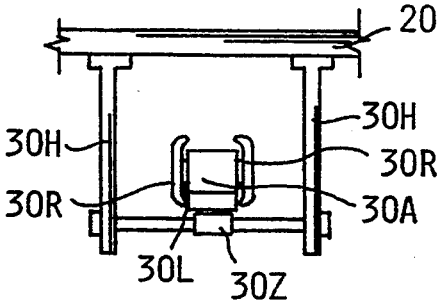
FIG. 13 is an elevational view taken along the lines 13—13 of FIG. 12.

When the mattress 22 has been covered, the mattress frame 20 and mattress 22 are pushed and slid inward. At this action, the retractable leg assembly 30 is again activated to cause the retractable leg 30A to pivot upwardly while at the same time, the three sections 30S,30Z and 30V of the multi-sectioned, retractable leg slide 30R are all caused to retract inward, until the retractable leg 30A is resting substantially horizontally near the leg slide 30R as shown in FIGS. 12, 13 and 14.

While the invention has been described in complete detail and pictorially shown in the accompanying drawings it is not to be limited to such details, since many changes and modifications may be made to the invention without departing from the spirit and the scope thereof. For example, in lieu of the movable front side 18, either the front end 12 or second end 14 could be designed to be raised and lowered to allow the mattress frame 20 to be pulled out as described above. Additionally, the basic concept of having a mattress frame 20 and mattress 22 that can be pulled away from the crib structure could also be accomplished by other methods, one such method would be to design a separate platform having wheels that are sized to be rolled in and out of the bottom area of the crib. On top of this platform would be located the mattress. Hence, the instant invention is described to cover any and all modifications and forms which may come within the language and scope of the claims.

We claim:

1. A baby crib with pull-out mattress comprising:

a) a first end and a second end each having legs, b) a mattress frame having a bottom surface and that is connected between said first and second ends, c) a mattress resting on said frame, d) a back side attached by an attachment means to said first and second ends adjacent to said mattress frame and mattress, e) a movable front side having means for being moved relative to said first and second ends a sufficient distance to permit said mattress frame and said mattress to be exposed, f) a retractable leg assembly comprising:

(1) a retractable leg having a first end, a center and a second end, where the center of said retractable leg is pivotally attached through a movable link and a leg broker to the bottom surface of said mattress frame, and (2) a retractable-leg slide assembly, connected between the back side of said baby crib and the first and of said retractable leg, said slide assembly adapted to retract said leg, whereby when said mattress frame is slide inward, said retractable leg pivots inward and rests substantially horizontally, and conversely when said mattress frame is slid outward, said retractable leg rotates downward from its retracted position to a near vertical position where the second end of said retractable leg touches the floor to support said mattress frame and mattress to conveniently permit the removal and application of mattress coverings.

2. The crib as specified in claim 1 wherein said means for moving said movable front side comprises a first and second vertical slide and locking assembly, wherein each assembly consists of a fixed section and a slideable section that permit said movable front side to be releasably retained in an upward position, where the fixed sections are attached respectively to the inner side of the front edge of said first and second ends, and the slideable sections are attached to the first and second side edges of said movable front side so that the slideable sections interface with the fixed sections, where when so attached, said movable front side can be positioned vertically, relative to said first and second ends, a sufficient distance to permit said mattress frame and mattress to be exposed.

3. The crib as specified in claim 1 wherein said movable front side further comprises a vertical hinge attached between the first side edge of said movable front side and the front edge of said first end, where the hinge allows the entire movable front side to pivot outwardly to permit said mattress frame and mattress to be exposed.

4. The crib as specified in claim 1 wherein said movable front side is vertically split into two separate pieces: a left piece and a right piece, a vertical hinge is attached between the first side edge and second side edge of said movable front side and to the front edges of said first and second ends, where between the two interfacing inward ends of the left and right pieces is located a latch pair that receives the two pieces together when they are in their closed positions, when the latch pair is unlatched each of the pieces pivots outwardly about the respective hinge to permit said mattress frame and mattress to be exposed.

5. The crib as specified in claim 1 wherein said front further comprises a pair of removable fasteners attached in alignment to the first and second side edges of the movable front side and to the front edges of said first and second ends, where said fasteners allow the entire movable front side to be removed to permit said mattress frame and mattress to be exposed.

6. The crib a specified in claim 1 wherein said means for allowing said mattress frame and mattress to slide outwardly comprises a first and second horizontal slide assembly with each assembly consisting of a fixed section and a slideable section, where the fixed sections extend laterally across the width of said first and second ends and are attached laterally to the inward inside surface of the respective legs, and the slideable sections are attached to the bottom surface of said mattress frame, where said first and second horizontal slide assemblies allow said mattress frame to slide outwardly away from said rear side for convenience in the application of mattress coverings.

7. The crib as specified in claim 1 wherein said retractable leg assembly further comprises:

a) a first pivot bore in the first end of said retractable leg and a second pivot bore in the second end of said retractable leg, the second pivot bore being substantially separated from the first pivot bore, b) a mounting block rigidly attached to the inside surface of said back side below said mattress frame, said block further having a third pivot bore therethrough, c) a bracket having an upper surface rigidly attached to the bottom surface of said mattress frame by an attachment means and a bottom end having a fourth pivot bore therethrough, d) a pair of movable links each having a first end and a second end, with the first end having a fifth pivot bore that is swivelly attached to the second pivot bore by means of a pin and with the second end having a sixth pivot bore that is swivelly attached to the fourth pivot bore by means of a pin, e) a multi-sectioned, retractable leg slide, having a front slide section with a forward end having a seventh pivot bore that is swivelly attached to the first pivot bore by means of a pin, and back slide section with a rearward end having an eighth pivot bore that is swivelly attached to the third pivot bore by means of a captive pin, where when said mattress frame is slid inward, said retractable leg is resting substantially horizontally near said multi-sectioned retractable leg slide, and conversely, where said mattress frame is slid outwardly, said retractable leg pivots about the first and seventh pivot bores and rotates downwardly from its retracted position to a near vertical position until fully extended where the leg touches the floor on its second end to support said mattress frame and mattress, and f) a slide stop-rod attached to the bottom surface of said mattress frame adjacent the intersection of the retractable leg with the front section of the multi-sectioned, retractable leg slide, where said slide stop-rod halts the travel of said mattress frame when it has reached its fully extended position.

8. The crib as specified in claim 7 further comprising leg height adjustment means.

9. The crib as specified in claim 8 wherein said leg height adjusting means comprises:

a) an upper tubular section having a plurality of first adjustment bores therethrough, b) a lower solid section having a plurality of second adjustment bores therethrough, and c) a pin inserted into said first and second pin bores to hold said retractable leg at a selectable height.

10. The crib as specified in claim 1 further comprising frame height adjustment means for changing the height of said mattress frame relative to said first and second ends sides.

11. A baby crib with pull-out mattress comprising:

a) a first end having a front edge, a back edge, a bottom inside edge and downwardly extending legs, b) a second end having a front edge, a back edge, a bottom inside edge and downwardly extending legs, c) a back side having a first side edge and a second side edge that are attached by an attachment means to the respective back edges of said first and second ends, d) a movable front side having a first side edge and a second side edge, e) a mattress frame having an upper surface, a bottom surface and having means for changing the height of said mattress frame relative to said first and second ends, (f) a mattress that rests upon the upper surface of said mattress frame, g) a first and second vertical slide and locking assembly where each assembly consists of a fixed section and a slideable section that permit said movable front side to be releasably retained in an upward or downward position, where the fixed sections are attached respectively to the inner side of the front edge of said first and second ends, and the slideable sections are attached to the first and second side edges of said movable front side so that the slideable sections interface with the fixed sections, where when so attached, said movable front side can be positioned vertically, relative to said first and second ends a sufficient distance to permit said frame and mattress to be exposed, h) a first and second horizontal slide assembly with each assembly consisting of a fixed section and a slideable section, where the fixed sections are attached laterally to the bottom inside edge of said first and second ends, and the slideable sections are attached to the bottom surface of said mattress frame, where said first and second horizontal slide assemblies allow said frame to slide outwardly away from said rear side for convenience in the application of mattress coverings, and i) a retractable leg assembly comprising:

(1) a retractable leg having a first end and a second end, with the first end having a first pivot bore and the second end having a second pivot bore substantially separated from the first pivot bore, (2) a mounting block rigidly attached to the inside surface of said back side below said mattress frame, said block further having a third pivot bore therethrough, (3) a bracket having an upper surface rigidly attached to the bottom surface of said mattress frame by an attachment means and a bottom end having a fourth pivot bore therethrough, (4) a pair of movable links each having a first end and a second end, with the first end having a fifth pivot bore that is swivelly attached to the second pivot bore by means of a pin and with the second end having a sixth pivot bore that is swivelly attached to the fourth pivot bore by means of a pin, (5) a multi-sectioned, retractable leg slide, having a front section with a forward end having a seventh pivot bore that is swivelly attached to the first pivot bore by means of a pin, and back section with a rearward end having an eighth pivot bore that is swivelly attached to the third pivot bore by means of a captive pin, where when said mattress frame is slid inward, said retractable leg is resting substantially horizontally near said multi-sectioned retractable leg slide, and conversely, where said mattress frame is slid outwardly, said retractable leg pivots about the first and seventh pivot bores and rotates downwardly from its retracted position to a near vertical position until fully extended where the leg touches the floor on its second end to support said mattress frame and mattress, and (6) a slide stop-rod attached to the bottom surface of said mattress frame adjacent the intersection of the retractable leg with the front section of the multi-sectioned, retractable leg slide, where said slide stop-rod halts the travel of said mattress frame when it has reached its fully extended position.

12. The crib as specified in claim 11 further comprising a safety cover that encloses said retractable leg assembly, with said cover having a longitudinal slot therethrough on its bottom surface that is sized to allow the retractable leg to pivotally be extended and retracted through the slot.

13. The crib as specified in claim 12 further comprising frame height adjustment means for changing the height of said mattress frame relative to said first and second ends sides.

14. The crib as specified in claim 12 further comprising leg height adjustment means.

15. The crib as specified in claim 12 wherein said leg height adjusting means comprises:

a) an upper tubular section having a plurality of first adjustment bores therethrough, b) a lower solid section having a plurality of second adjustment bores therethrough, and c) a pin inserted into said first and second pin bores to hold said retractable leg at a selectable height.

* * * * *